United States Patent [19]

Neeley

[11] 4,385,021

[45] May 24, 1983

[54] METHOD FOR MAKING AIR HOSE BUNDLES FOR GUN ARRAYS

[75] Inventor: Walter P. Neeley, Irving, Tex.

[73] Assignee: Mobil Oil Corporation, New York, N.Y.

[21] Appl. No.: 283,246

[22] Filed: Jul. 14, 1981

[51] Int. Cl.[3] ..... H01B 7/00

[52] U.S. Cl. ..... 264/173; 174/47; 264/103; 264/174; 425/113

[58] Field of Search ..... 264/174, 173, 103; 174/47, 113 C; 425/113, 114

[56] References Cited

U.S. PATENT DOCUMENTS

| | | | |
|---|---|---|---|
| 1,977,209 | 10/1934 | Sargent | 264/174 |
| 3,415,919 | 12/1968 | Kippan | 264/174 |
| 3,435,410 | 3/1969 | Babb | 174/47 |
| 3,443,374 | 5/1969 | Carnevale | 264/174 |
| 3,483,313 | 12/1969 | Schaffhauser | 174/47 |
| 3,603,718 | 9/1971 | Gedenk | 174/47 |
| 3,654,380 | 4/1972 | Tatum et al. | 174/47 |
| 3,664,781 | 5/1972 | Widman | 425/113 |
| 3,762,142 | 10/1973 | Rasmussen | 264/174 |
| 4,196,307 | 4/1980 | Moore et al. | 174/47 |

FOREIGN PATENT DOCUMENTS

| | | | |
|---|---|---|---|
| 49-34447 | 9/1974 | Japan | 264/174 |

*Primary Examiner*—Jeffery R. Thurlow

*Attorney, Agent, or Firm*—C. A. Huggett; M. G. Gilman; F. J. Kowalski

[57] ABSTRACT

A method is disclosed for structuring a plurality of supply and control conduits having a length substantially greater than its cross sectional width wherein the control conduits for each supply conduit are segregated and covered. The segregated and covered control conduits are bundled in a generally annular shape and the supply conduits are placed around the control conduits in a generally circular fashion. The entire bundle is then covered to retain its circular shape by periodically fastening the resultant bundle circumferentially or by extruding a covering over its entire length.

5 Claims, 2 Drawing Figures

METHOD FOR MAKING AIR HOSE BUNDLES FOR GUN ARRAYS

BACKGROUND OF THE INVENTION

The present invention pertains to methods for bundling a plurality of conduits and more particularly to bundling a plurality of supply and control conduits which extend over a length that greatly exceeds their total cross sectional width.

Prior art teaches several methods for grouping or bundling a plurality of conduits which extend significant lengths for use in operations such as marine seismic exploration.

In marine seismic exploration, a plurality of seismic pulse sources are towed behind a marine vessel. Seismic pulse detectors which receive seismic pulses when the sources are energized and when the pulses are reflected or refracted by subsurface formations may either be towed behind the same marine vessel or be placed on the ocean bottom. Typically, the seismic pulse sources are air guns which receive an air supply and firing control signals from the marine vessel. Each air gun includes a transducer and a firing solenoid. Four control wires or conduits are required for operation, two for the transducer and two for the solenoid. A prior art method for bundling these conduits is illustrated in FIG. 1. Control wires 10 are grouped together to form a center core 12 around which air supply hoses 14 are placed. The entire bundle is then covered with a watertight sleeve 16 to protect control wires 10 and supply hoses 14 from salt water damage. However, if the sleeve is damaged by collision or other occurances, salt water will enter sleeve 16 and saturate the control wires 10. If the wires are in any way damaged, leakage can occur not only between wires of the same control pair but also between wires of different control pairs. Thus, the probability of wire damage disabling more than one seismic pulse source is increased.

In marine exploration, a plurality of pulse sources such as forty are connected together as one operator. These sources are typically towed behind a marine vessel along with several miles of acoustic pulse detectors. When the operator becomes ineffective such as with the loss of a significant percentage of the total pulse sources, marine exploration must be halted and the operator must be pulled on board for repairs. Usually the percentage lost must be equal to or greater than ten percent which in the example of a forty point operator is four. When the operator is pulled on board, the line of pulse detectors, which may be several miles long, drifts due to ocean currents and wave force. The changed location of the detectors requires that the marine vessel circle and reperform or reshoot the seismic exploration line. This results in great expense and loss of exploration time.

SUMMARY OF THE INVENTION

The present invention discloses a method for structuring a plurality of control and supply conduits to provide a resulting arrangement providing increased protection for the control conduits. The method includes grouping the control conduits so that each set of control conduits is segregated and electrically insulated from the others. The groups of control conduits are also isolated from and surrounded by supply conduits. The entire group of conduits are then bound together by a casing extruded over the entire group.

In an alternate embodiment, the entire group of conduits may be bound together by periodic circumferential straps.

DESCRIPTION OF THE PREFERRED EMBODIMENT

As previously discussed, a major problem with prior art methods of bundling a plurality of conduits for marine use such as seismic pulse source cables, is the loss of sources comprising an operator through the loss of control of a significant portion of the sources.

Figure 1:
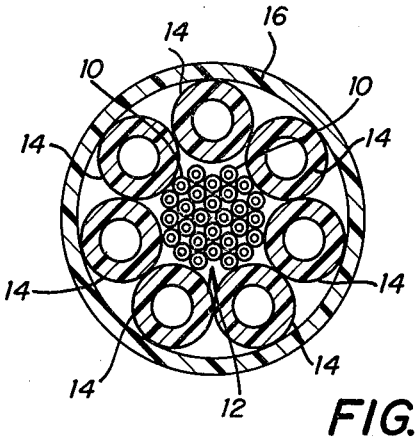
FIG. 1 illustrates a cross sectional view of a prior art method of bundling conduits.

In marine exploration a plurality of seismic pulse source generators are towed by a marine vessel. These pulse sources comprise an operator which receives its pulse generating capability and control from the marine vessel. While being towed through the water, the operator may be damaged by collision with floating debris, boats, etc., Although the control conduits are surrounded by supply conduits (see FIG. 1), they may still be damaged. There are two pairs of wires associated with each seismic pulse source, two for the transducer and two for the solenoid. The solenoid controls a valve which fires the seismic pulse source and the transducer detects when the source fires. When one wire of a pair is damaged, the efficiency of operation may be reduced if not completely disabled. When two wires are damaged, a short may result when a return path is provided for control signals. In the prior art arrangement illustrated in FIG. 1, there is a great probability of shorting between control conduits of different seismic pulse sources. Thus, when the two wires are damaged, two pulse sources may be disabled instead of merely having their efficiency diminished or one source being disabled.

Figure 2:
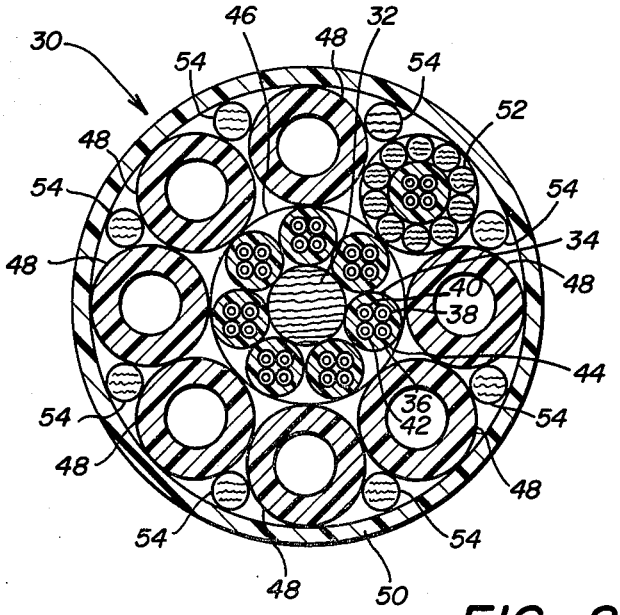
FIG. 2 illustrates a cross-sectional view of the preferred embodiment of the present invention.

Referring now to FIG. 2 a cross sectional view of a marine seismic cable is illustrated. For simplicity a cable having seven seismic pulse generators is illustrated. Seismic cable 30 is illustrated as having a center core 32 with seven sets of control conduits 34 each having a set of four control wires 36, 38, 40 and 42. Each group 34 is jacketed by a non-conductive casing 44. Groups 34 are arranged around center core 32 in a generally annular shape 46. Air supply hoses 48 are placed symmetrically around annular shape 46 to provide a bundle having a generally circular shape. The generally circular shape, having air supply hoses 48 approximately forming its circumference, is held into position to retain its shape by covering 50.

Group 34 has four control conduits which may be any type of control wire currently known in the art and may be paired such as control conduits 36 and 38 for control of a solenoid (not shown) and control conduits 40 and 42 for control of a transducer (not shown). Center core 32 may be of any substance which is pliable and allows cable 30 to be wound around a large reel. However, one quarter inch polypropylene rope is preferred.

In order to maintain the generally circular shape of cable 30 an additional conduit 52 has been added. Additional conduit 52 may be a spare supply hose 48 or may be, as depicted in FIG. 2, an additional grouping of control conduits 34. Additional spacers 54 are illustrated as providing additional filler to retain the circular shape of covering 50. Spacers 54 may also be of any pliable type of material currently used in the art. However, one quarter inch polypropylene rope filler is again preferred.

Covering 50 is preferably a water tight covering made of polyurethane, however any pliable water tight covering may be used. Polyurethane is preferred since it may be extruded over the conduit bundle by processes currently known in the art. As an alternate embodiment, covering 50 may be eliminated and the generally circular shape of cable 30 may be retained by placing salt water resistant straps around the circumference of a circle defined by the tangential points of filler 54 and air supply conduits 48 outermost from center core 32.

The number of acoustic pulse sources (not shown) may be increased with slight modification to the foregoing description of cable 30.

An additional air supply hose 48 may replace filler 52 and an additional control conduit group 34 may be used in lieu of center core 32 to provide a cable for 8 seismic pulse sources. Varying sizes up to a cable with capability for as many as 40 seismic pulse sources may be produced according to the method of the present invention while still retaining the basic principle of segregating and isolating the control wires for each acoustic pulse source.

A preferred embodiment has been described by way of illustration only. It is to be understood that the present invention is not to be limited thereto but only by the scope of the following claims.

What is claimed is:

1. A method for bundling a seismic pulse generation cable including control wires and supply hoses for a plurality of devices comprising the steps of:

placing the set of control wires associated with each device in a group;

jacketing each of said groups within a non-conductive casing;

placing said jacketed groups around a center core in a generally annular shape;

placing the supply conduits symmetrically around said annular shape to provide a bundle having a generally circular shape, and covering said bundle to retain said generally circular shape.

2. The method according to claim 1 wherein the step of covering said bundle includes fastening said bundle at periodic intervals with circumferential salt water resistent straps.

3. The method according to claim 1 wherein the step of covering said bundle includes extruding a water tight coating the entire length of said bundle.

4. The method according to claim 2 or 3 also including the step of placing spacers of pliable filler material between said supply conduits to insure a generally circular shape.

5. The method according to claim 1 wherein said center core is replaced with an additional jacketed group of control wires and an additional supply hose is added to said bundle.

* * * * *